US006913041B2

(12) United States Patent
Lehnhardt et al.

(10) Patent No.: US 6,913,041 B2
(45) Date of Patent: Jul. 5, 2005

(54) TAPERED BOOM HOSE

(75) Inventors: Gary D. Lehnhardt, Cedar Grove, WI (US); Rolando Altamirano, Grafton, WI (US)

(73) Assignee: Construction Forms, Inc., Port Washington, WI (US)

( * ) Notice: Subject to any disclaimer, the term of this patent is extended or adjusted under 35 U.S.C. 154(b) by 0 days.

(21) Appl. No.: 10/271,958

(22) Filed: Oct. 15, 2002

(65) Prior Publication Data

US 2004/0069356 A1 Apr. 15, 2004

(51) Int. Cl.[7] ..... F16L 11/00
(52) U.S. Cl. ..... 137/615; 138/118
(58) Field of Search ..... 138/118, 118.1, 138/120; 137/615

(56) References Cited

U.S. PATENT DOCUMENTS 3,651,832 A * 3/1972 Meyer ..... 137/615
4,954,055 A * 9/1990 Raible et al. ..... 138/118
5,988,700 A * 11/1999 Prichard ..... 138/118
6,142,180 A * 11/2000 Woodling et al. ..... 137/615

FOREIGN PATENT DOCUMENTS

| | | | | |
|---|---|---|---|---|
| DE | 3224755 A | | 1/1984 | |
| DE | 29507683 U | | 7/1995 | |
| GB | 1412115 A | | 10/1975 | |
| JP | 10016075 A | * | 7/1996 | ..... B29C/47/02 |

* cited by examiner

*Primary Examiner*—Kevin Lee
(74) *Attorney, Agent, or Firm*—Andrus, Sceales, Starke & Sawall, LLP

(57) ABSTRACT

A concrete boom hose is provided with a first end that is connected to the outermost end of a series of concrete pipes and a second end through which the flowing concrete exits. The second end is provided with an inner diameter that is smaller than the inner diameter of the first end that is connected to the concrete pipe.

5 Claims, 2 Drawing Sheets

TAPERED BOOM HOSE

FIELD OF THE INVENTION

The present invention relates to boom hoses utilized in a concrete delivery system.

BACKGROUND OF THE INVENTION

Typically, concrete is delivered at a job site to remote areas via a system that pumps the concrete through a series of boom connected pipes terminating in a flexible delivery hose.

It is desirable to slow down the flow of concrete from the end of the boom to the tip of the boom hose in order to reduce the force of free falling poured concrete and thus decrease the impact force against the walls of the concrete forms. It is also desirable to slow down the flow of concrete in order to reduce the splashing of concrete around the area being poured and to better control the air content of the poured concrete.

In the past, the flow of concrete has been slowed by utilizing a number of methods. One such method was the use of a metal boom "reducer" (funnel). The use of a reducer and its associated coupling adds additional weight to the boom, especially when the reducer is full of concrete. With today's modem boom lengths, the added weight presents serious problems that often will require additional counter weights to keep the concrete pumping truck balanced.

The flow has also been slowed down by utilizing a "Ram's Horn" that forces the flowing concrete through a spiral in order to slow it down.

The industry also utilizes a bend or kink in the hose in order to reduce the inner diameter of the hose.

However, both of these methods have the drawback of disrupting the smooth, even flow of the concrete.

It is the object of the present invention to provide a boom hose that slows down the flow of concrete without the need of any additional equipment such as a Ram's Horn or metal reducer. It is also an object of the present invention to provide a boom hose that will slow the flow of concrete and yet provide a smooth, even flow to better control the air content of the pumped concrete.

BRIEF SUMMARY OF THE INVENTION

A boom hose for use in a concrete pumping system of the type utilizing a concrete pump to provide the flow of concrete through a series of concrete pipe sections includes a flexible hose having a first end coupled to the outer end of a concrete pipe, with the first end having a first inner diameter.

In accordance with another aspect of the invention, the boom hose is provided with a second end that has a second inner diameter that is smaller than the first inner diameter.

The present invention thus provides a boom hose that slows the flow of concrete from the end of the concrete pipe without the need of any additional equipment such as a Ram's Horn or metal reducer.

The present invention also provides a smooth, even flow of concrete from the end of the hose by eliminating the free flow of concrete from the tip of the boom to the tip of the hose. The taper of the hose allows the hose to remain full of concrete for a longer period of time, thus providing a uniform, even flow.

Various other features, objects, and advantages of the invention will be made apparent from the following detailed description and the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
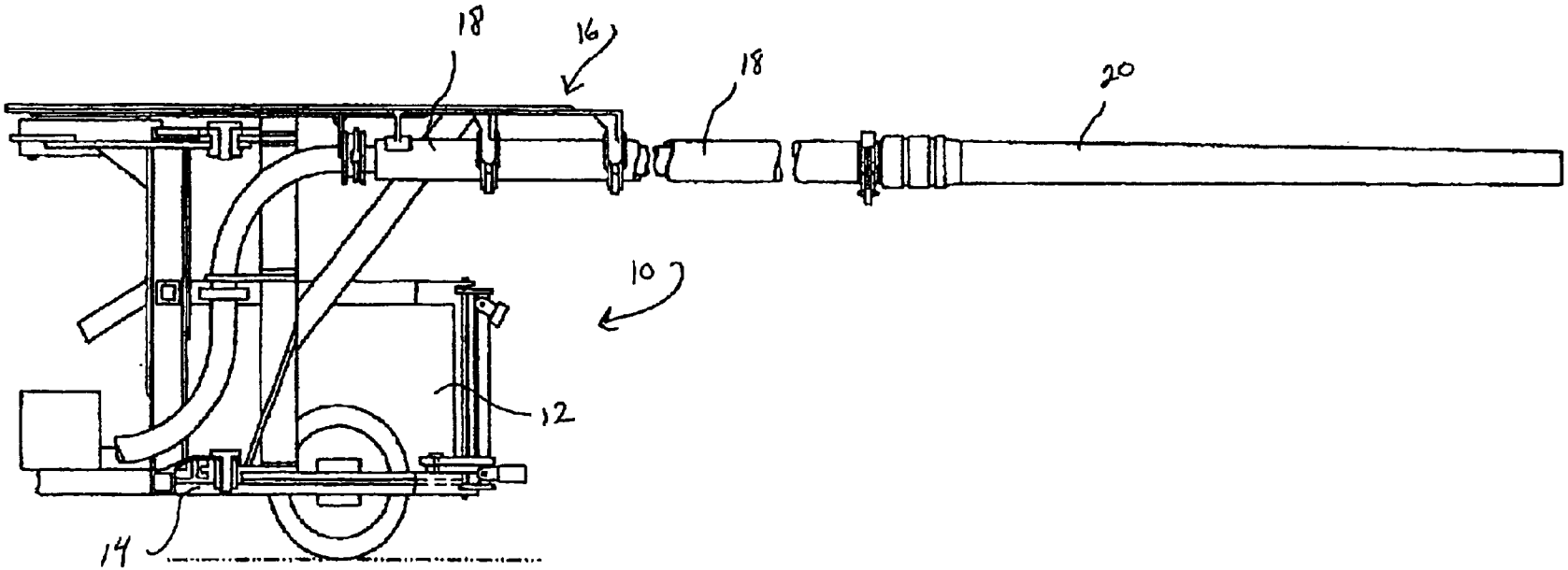
FIG. 1 is a side view of a concrete pumping system utilizing a boom hose constructed according to the present invention.

As shown in FIG. 1, a concrete pumping system 10 includes a concrete pump 12 mounted on a truck chassis 14.

Concrete is delivered to a remote site via a concrete boom 16 comprised of a series of interconnected concrete pipes 18 terminating in a flexible boom hose 20.

Figure 2:
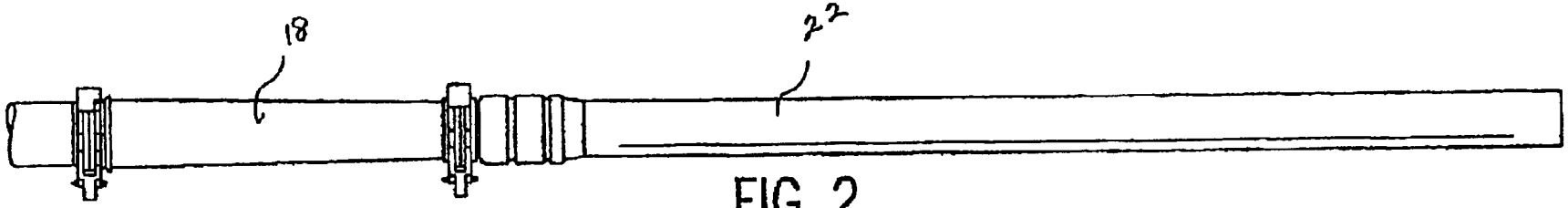
FIG. 2 PRIOR ART
FIG. 2 is a side view of a prior art boom hose.

As shown in FIG. 2, a prior art boom hose would have a uniform diameter throughout its length.

Figure 5:
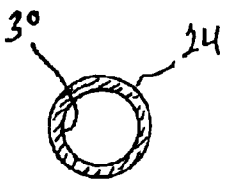
FIG. 5 is a cross-sectional view of the inner end of the boom hose.
Figure 4:
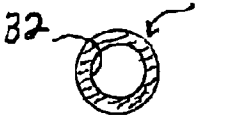
FIG. 4 is a cross-sectional view of the outer end of the boom hose.
Figure 3:
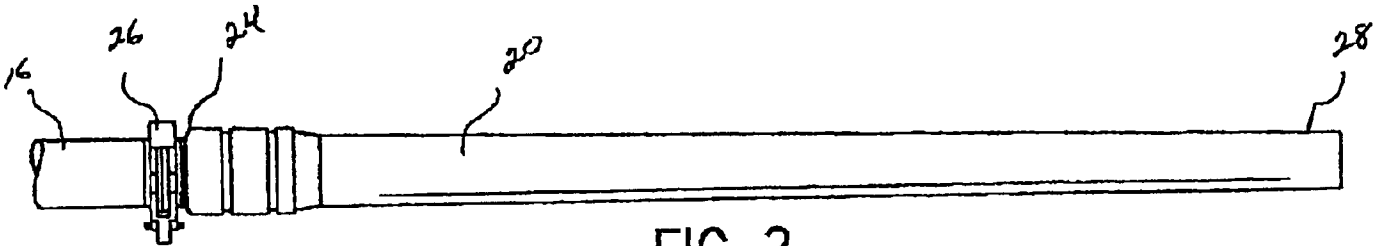
FIG. 3 is a side view of a boom hose constructed according to the present invention.

In accordance with the present invention, as shown in FIGS. 3–5, boom hose 20 is provided with a first end 24 that is connected to concrete pipe 16 via pipe coupling 26. First end 24 is provided with an inner diameter 30 of approximately five inches.

In accordance with the invention, boom hose 20 is provided with a second end 28 through which the pumped concrete exits. Second end 28 is provided with an inner diameter 32 of approximately four inches so that the flow of concrete from pipe 16 is slowed as it travels through boom hose 20.

Typically, boom hose 20 has a length of approximately twelve feet. Obviously, the above referenced inner diameters and hose lengths can be varied according to the requirements of the job as long as the inner diameter 32 of hose tip 28 is smaller than the inner diameter 30 of the hose at its connection point 24.

It is recognized that other equivalents, alternatives, and modifications aside from those expressly stated, are possible and within the scope of the appended claims.

We claim:

1. A boom hose for use in a concrete pumping system of the type utilizing a concrete pump to provide a flow of concrete through a series of pipe sections to a hose for distribution of the concrete into a form or other area, said boom hose comprising:

a length of flexible tubing having a first end coupled to the outer end of a delivery pipe, said first end having a first inner diameter and a second end from which the concrete flows, said second end having a second inner diameter with said second inner diameter being smaller than said first inner diameter, said flexible tubing having a uniform and continuous taper along its entire length from said first inner diameter to said second inner diameter.

2. The boom hose defined in claim 1 wherein said second inner diameter is substantially eighty percent (80%) of said first inner diameter.

3. The boom hose defined in claim 1 wherein said boom hose has a length in excess of ten feet (10').

4. The boom hose defined in claim 1 wherein said first inner diameter is substantially five inches and said second inner diameter is substantially four inches.

5. A boom hose for use in a concrete pumping system of the type utilizing a concrete pump to provide a flow of concrete through a series of concrete pipe sections to a hose for distribution of the concrete into a form or other area, said boom hose comprising:

a length of flexible tubing having a first end coupled to the outer end of a concrete pipe, said first end having a first inner diameter and a second end from which the concrete flows, said second end having a second inner diameter with said second inner diameter being substantially eighty percent (80%) of said first inner diameter, said flexible tubing having a uniform and continuous taper along its entire length from said first inner diameter to said second inner diameter.

* * * * *